US006378991B1

(12) United States Patent
Lim et al.

(10) Patent No.: US 6,378,991 B1
(45) Date of Patent: Apr. 30, 2002

(54) THERMAL-COMPRESSION TYPE FLUID JETTING APPARATUS USING INK

(75) Inventors: Dae-soon Lim; Jae-ho Moon, both of Kyungki-do (KR)

(73) Assignee: SamSung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 09/664,525

(22) Filed: Sep. 18, 2000

(30) Foreign Application Priority Data

Nov. 4, 1999 (KR) ..... 1999-48547

(51) Int. Cl.[7] ..... B41J 2/05
(52) U.S. Cl. ..... 347/56; 347/65
(58) Field of Search ..... 347/20, 54, 47, 347/65, 67, 94, 63, 70

(56) References Cited

U.S. PATENT DOCUMENTS 5,097,275 A * 3/1992 Takita ..... 347/65
5,635,966 A * 6/1997 Keefe et al. ..... 347/65
5,821,962 A * 10/1998 Kudo et al. ..... 347/65

* cited by examiner

*Primary Examiner*—John Barlow
*Assistant Examiner*—Juanita Stephens
(74) *Attorney, Agent, or Firm*—Robert E. Bushnell, Esq.

(57) ABSTRACT

A fluid jetting apparatus includes a nozzle part, a driving part, and a membrane. The nozzle part has an ink chamber and a nozzle hole. The driving part has a working fluid chamber and a heating element. The membrane serves as a partition between the ink chamber and the working fluid chamber. The working fluid chamber has an ink feeding hole through which the ink is fed from an external ink source. An intercommunicating hole is formed on the ink chamber, intercommunicated with the working fluid chamber. The ink is fed into the working fluid chamber and is fed to the ink chamber through an intercommunicating passage. During the heating operation of the heating element, the ink chamber is pressured by the membrane, so that the ink is jetted through the nozzle hole. The ink in the working fluid chamber flows into the ink chamber through the intercommunicating passage, and the ink flows into the working fluid chamber through the ink feeding hole. Accordingly, the working fluid chamber is cooled, and the durability of the fluid jetting apparatus is lengthened.

6 Claims, 4 Drawing Sheets

THERMAL-COMPRESSION TYPE FLUID JETTING APPARATUS USING INK

This application makes reference to, incorporates the same herein, and claims all benefits accruing under 35 U.S.C. §119 from the inventor's application THERMAL-COMPRESS TYPE FLUID JETTING APPARATUS USING INK filed with the Korean Industrial Property Office on Nov. 4, 1999 and there duly assigned Ser. No. 48547/1999.

BACKGROUND OF THE INVENTION

FIELD OF THE INVENTION

The present invention relates to a paper-copy output apparatus such as an inkjet printer or facsimile machine. More particularly, the invention concerns a thermal-compression type of fluid jetting apparatus employed in a print head of such a print output apparatus. The invention also concerns a method of making paper copies by means of such an apparatus.

DESCRIPTION OF THE RELATED ART

Generally, a fluid jetting apparatus employed in a print head of an output apparatus such as an inkjet printer or a facsimile machine, ejects ink in from ink chamber outward through a nozzle by exerting physical force to the ink chamber. Such fluid jetting apparatuses include thermal type, piezoelectric, and thermal-compression devices to exert the physical force to eject the fluid.

One thermal-compression fluid jetting apparatus of the prior art is shown in FIG. 1. The fluid jetting apparatus includes a driver module 20, a membrane 30, and a nozzle module 40.

Driver module 20 includes a substrate 15, a fluid chamber subassembly 25 having a plurality of working fluid chambers 27, a plurality of heating elements 16 disposed within the respective working fluid chambers, and a plurality of electrodes 17 connected with the respective heating elements.

Nozzle module 40 includes an ink chamber subassembly 45 having a plurality of ink chambers 57, and a nozzle plate 47 connected to an upper side of the ink chamber. Nozzle holes 49 are formed on the upper side of the nozzle plate, corresponding in location to the respective ink chambers.

Membrane 30 is disposed between the ink chamber and the fluid chamber. The membrane serves the function of partition between the working fluid chambers and the ink chambers.

Substrate 15, fluid chamber subassembly 25, membrane 30, and ink chamber subassembly 45 have correspondingly located ink feeding holes 11, 21, 31, and 41, which intercommunicate with one another. Ink feeding hole 41 of the ink chamber communicates with the ink chambers via an ink feeding passage 59. Ink feeding hole 11 of substrate 15 communicates with an external ink source (not shown). Accordingly, the ink is fed from the external ink source into the ink chambers through the feeding holes 11, 21, 31, and 41, and ink feeding passage 59.

Nozzle plate 47, ink chamber 45, membrane 30, and fluid chamber member 25 have corresponding fluid feeding holes 53,43, 33, and 23, which communicates with one another. Fluid feeding hole 23 of the fluid chamber intercommunicates with the working fluid chambers through a fluid feeding passage 29. The working fluid is charged in the working fluid chambers through fluid feeding holes 53, 43, 33, and 23, and fluid feeding passage 29. Fluid feeding hole 53 of the nozzle plate is sealed to be air-tight by a sealing member 55, after working fluid is charged in the working fluid chambers 27, fluid feeding passage 29 and fluid feeding holes 23, 33, and 43.

When electricity is applied to electrodes 16, heating elements 17 generate heat. The working fluid in the working fluid chambers is heated, forming bubbles. The bubbles increase the volume of the working fluid chambers, upwardly pressing and curving membrane 30. Accordingly, the ink in the ink chambers is pushed and jetted through nozzle holes 49.

The foregoing conventional fluid jetting apparatus, however, has a shortcoming of complicated manufacturing processes. It requires a process for separately preparing the ink and the working fluid, and a sealing process after the working fluid is discharged into the working fluid chambers. Further, since the working fluid employs an organic solvent such as a heptane which is apt to evaporate easily, there is a likelihood of having unnecessary space in the working fluid chambers. When the space is formed in the working fluid chambers, the intensity of the pressure exerted on membrane 30 during the heating of heating elements 16 becomes insufficient, so that the quantity of the jetted ink can not be precisely controlled.

In order to solve the problem of the conventional fluid jetting apparatus, the same applicant has previously disclosed a 'Thermal-compression type fluid jetting apparatus', which utilizes ink as the working fluid as shown in FIG. 2.

As shown in FIG. 2, a substrate 115, a fluid chamber subassembly 125, a membrane 130, and an ink chamber subassembly 145 have corresponding ink feeding holes 111, 121, 131, and 141 which intercommunicate. Ink feeding hole 141 of the ink chamber subassembly communicates with ink chambers 157 through an ink feeding passage 159. Ink feeding hole 121 of fluid chamber subassembly 125 communicates with working fluid chambers 127 through an ink feeding passage 129. Accordingly, ink chambers 157 and working fluid chambers 127 communicate with one other.

Ink feeding hole 111 of substrate 115 communicates with an external ink source. The ink is fed from the ink source to working fluid chambers 127 and ink chambers 157 through ink feeding holes 111, 121, 131, and 141, and ink feeding passages 129 and 159. The ink fed into the working fluid chambers 127 is the working fluid.

As electricity is applied to electrodes 116, heating elements 117 generate heat. As described earlier, the ink in the ink chambers is pushed, and is then jetted out through the nozzle holes by the deformation of the membrane. In such an ink jetting apparatus, since the ink is used as the working fluid, there is no need to separately prepare the working fluid, and also no need for the sealing process. Also, the malfunction of the ink jetting apparatus is prevented.

The above-described ink jetting apparatus utilizing the ink as the working fluid, however, has the following problem: While the ink in working fluid chambers 127 is pushed out by the expansion of the bubble produced due to the heating of the heating elements, there is no constant supply of ink thereto. Accordingly, the pressure of the ink jetting decreases, and the quantity of the jetted ink becomes insufficient. As a result, the print quality deteriorates, especially in continuous performance of the printing operation.

Further, the repetitive heating of the heating elements 117 increases the temperature in the working fluid chambers, and the durability of the fluid jetting apparatus is shortened due to the excessive heat.

SUMMARY OF THE INVENTION

Accordingly, an object of the present invention is to provide a fluid jetting apparatus having a consistently high print quality by maintaining a constant ink jetting pressure, and also having longer durability by preventing excessive heat.

The above object is accomplished by a thermal compression type fluid jetting apparatus including a nozzle part, a driving part, and a membrane. The nozzle part includes an ink chamber for reserving the ink, and a nozzle hole for permitting the ink in the ink chamber to be jetted therethrough. The driving part has a heating element received in the working fluid chamber, forming a working fluid chamber. The membrane serves as a partition between the ink chamber and the working fluid chamber. During the heating operation of the heating element, the membrane is curved by the increased pressure in the working fluid chamber, and thus pressurizes ink in the ink chamber. The working fluid chamber includes an ink feeding hole formed thereon for receiving ink from an external ink source, and the ink chamber includes an intercommunicating passage which communicates with the working fluid chamber. Accordingly, the ink fed into the working fluid chamber is fed into the ink chamber through the intercommunicating passage.

In the ink jet process of the present invention, the ink is constantly fed into the working fluid chamber. As a result, the possible pressure decrease and excessive heat in the working fluid chamber are prevented.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components.

DETAILED DESCRIPTION OF THE PREFERRED EMBODIMENTS

The present invention will be described in greater detail with reference to the accompanying drawings.

Figure 1:
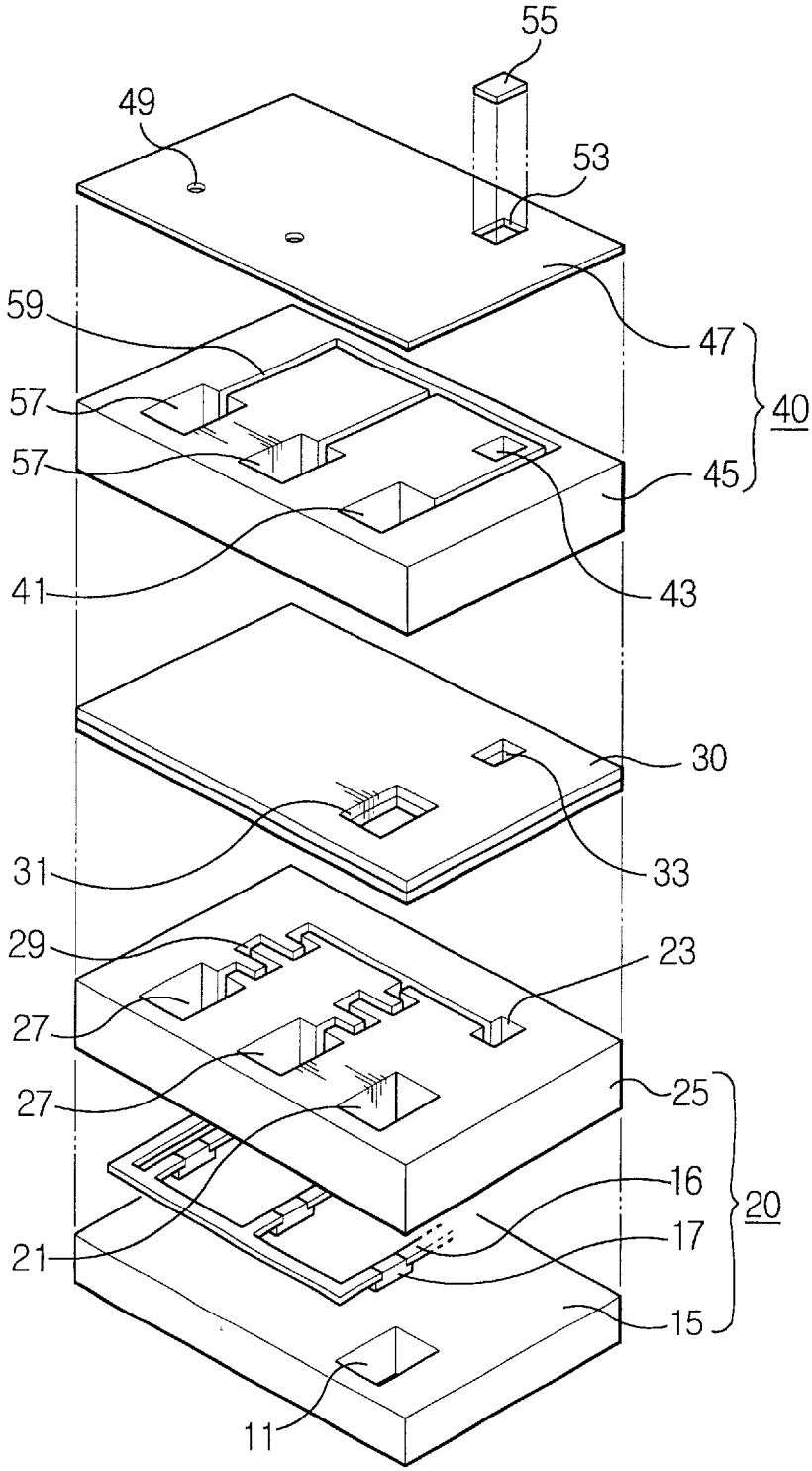
FIG. 1 (PRIOR ART)
FIG. 1 is an exploded perspective view of a conventional fluid jetting apparatus.
Figure 2:
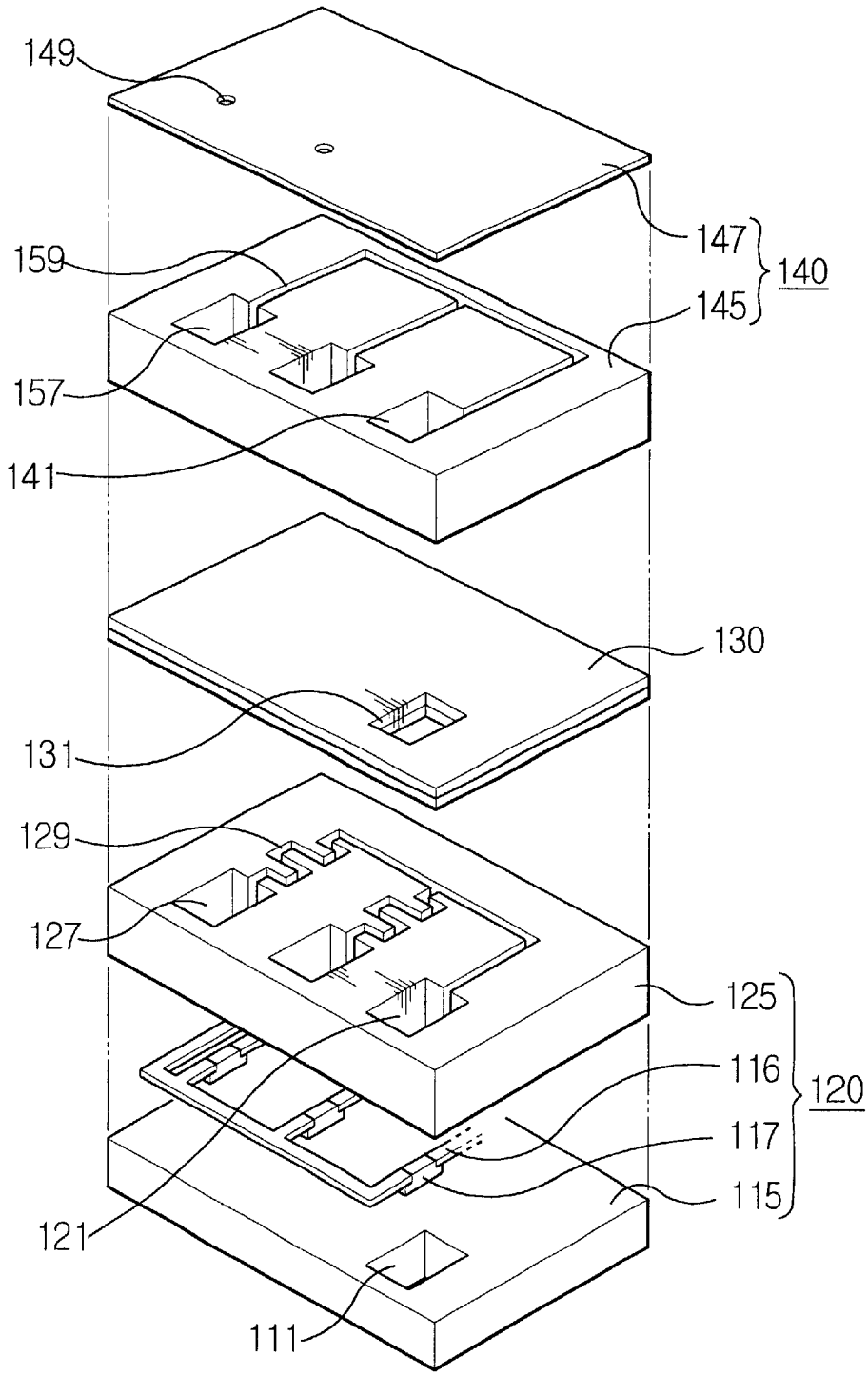
FIG. 2 is an exploded perspective view of a fluid jetting apparatus of the related art.
Figure 3:
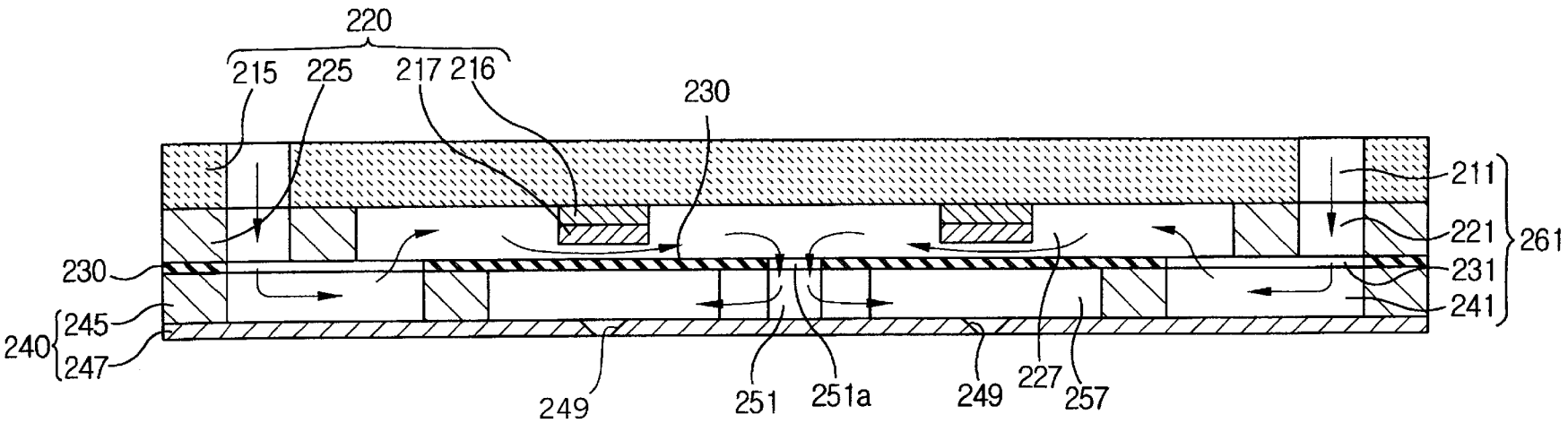
FIGS. 3 and 4 are sectional views of a fluid jetting apparatus according to the present invention.
Figure 4:
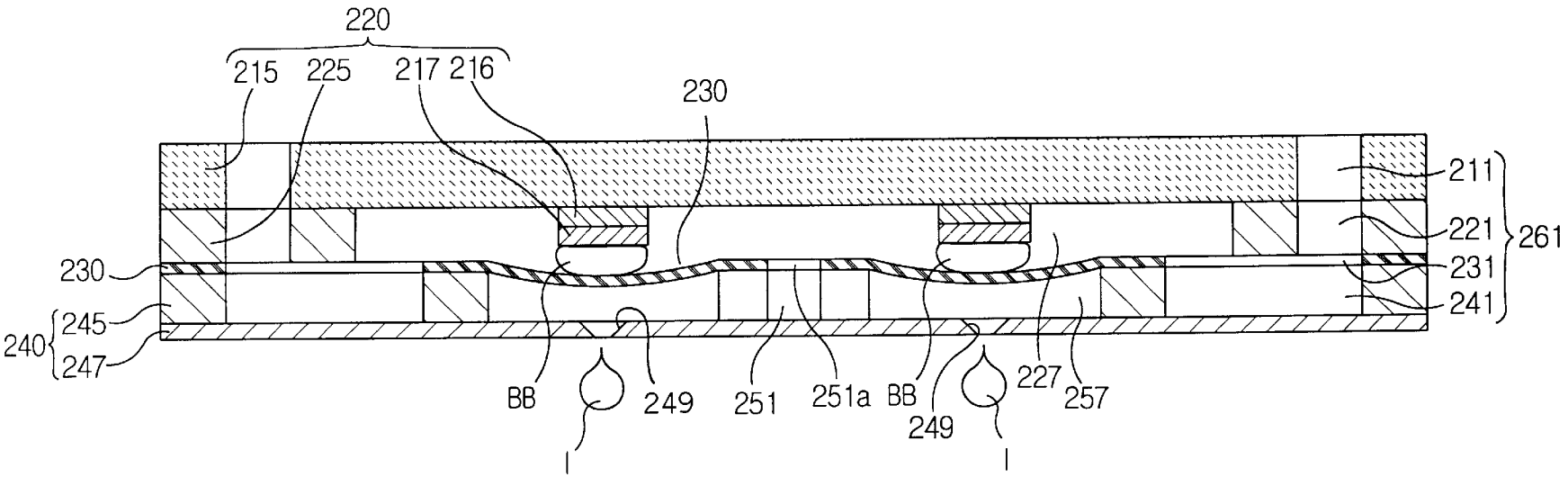

Referring to FIGS. 3 and 4 which show sectional views of a thermal-compression fluid driving apparatus according to the present invention, it is seen that, like the conventional fluid jetting apparatus, the fluid jetting apparatus of the present invention includes a driving module 220, a membrane 230, and a nozzle module 240. As in the prior art:

(a) Driving module 220 includes a substrate 215, a fluid chamber subassembly 225 having a plurality of working fluid chambers 227, heating elements 216 disposed in working fluid chambers 227, and electrodes 217 connected with heating elements 216.

(b) Nozzle module 240 includes an ink chamber subassembly 245 having a plurality of ink chambers 257, and a nozzle plate 247 connected to the upper side of ink chamber subassembly 245. The nozzle plate has nozzle holes 249 corresponding to the respective ink chambers.

(c) Membrane 230 is disposed between the ink chamber subassembly and the fluid chamber subassembly. The membrane 230 serves the function of partition between the working fluid chambers 227 and the ink chambers 257.

Substrate 215, fluid chamber subassembly 225, membrane 230, and ink chamber subassembly 245, have ink feeding holes 211, 221, 231, and 241, which communicate with one another. The respective ink feeding holes 211, 221, 231, and 241 intercommunicate to form an ink feeding passage 261. The membrane 230 has an intercommunicating hole 251*a* on the middle portion thereof. Due to the presence of intercommunicating hole 251*a*, an intercommunicating passage 251 is formed, so that working fluid chambers 227 and ink chambers 227 intercommunicate. Ink feeding hole 231 of membrane 230 and intercommunicating passage 251 on each working fluid chamber 227 are located opposite one another. Accordingly, working fluid chamber 227 has two opposite open sides.

Ink feeding hole 211 of substrate 215 intercommunicates with an external ink source. Accordingly, the ink fed from the external ink source is charged in working fluid chambers 227 through ink feeding passage 261. The ink charged in working fluid chamber 227 is further fed to ink chambers 257 through intercommunicating passage 251.

As shown in the drawings, a pair of working fluid chambers 227 and ink chambers 257 are arranged symmetrically in a row. There are a plurality of the rows, having symmetrically arranged working fluid chambers 227 and ink chambers 257 therein. Intercommunicating passage 251 is formed on the middle portion of the membrane 230. Accordingly, the pair of ink chambers 257 actually share one common intercommunicating passage 251. As a result, the ink fed to working fluid chambers 257 through ink feeding passages 261 on both sides converges in intercommunicating passage 251 in the middle, and is then fed to ink chambers 257.

In order to charge ink in the working fluid chambers 227 and ink chambers 257 through ink feeding passage 261, a vacuum device is used. First, a connection is made to ink feeding hole 211 to evacuate the inner space of working fluid chambers 227 and ink chambers 257. Next, the ink source is connected to ink feeding hole 211. The ink is charged in ink feeding passage 261, working fluid chambers 227, intercommunicating hole 251, and ink chambers 257 from the ink source by the suction force.

FIG. 4 is a sectional view for further explaining the operation of the ink jetting apparatus according to the present invention. As electricity is applied to electrodes 216 in the state as shown in FIG. 3, heating elements 217 generate heat. The ink within working fluid chambers 227 is heated, forming the bubbles BB as shown in FIG. 4. The volume of the working fluid chambers 127 is increased by the bubbles BB, and accordingly, membrane 230 is upwardly curved as shown in FIG. 4. Accordingly, the ink in ink chambers 257 is pushed, and jets through nozzle holes 249.

As heating elements 217 stop operation, membrane 230 recovers its initial state as shown in FIG. 3. Accordingly, pressure in ink chambers 257 decreases, while the ink in working fluid chambers 227 flows into ink chambers 257 through intercommunicating passage 251. Accordingly, the ink is newly charged in working fluid chambers 257 from the ink source through ink feeding passage 261. As described above, whenever the ink I is jetted through nozzle holes 249, the ink is newly fed into working fluid chambers 227. Hence, the working fluid chambers 227 are cooled by the infusion of newly fed ink during the cyclic heating operation of heating elements 217. Accordingly, the durability of the ink jet apparatus is lengthened.

Meanwhile, as shown in FIG. 4, the bubbles BB produced during the heating operation of heating elements 217 function both to press membrane 230 and to block the passage in working fluid chambers 227 during the heating operation of heating elements 217. Accordingly, while ink chamber 257 is pressurized by the bubbles BB, a possible back flow of the ink from working fluid chambers 227 to ink feeding passage 261 is prevented. Further, since the pair of working fluid chambers 227 and ink chambers 257 are formed in a symmetric structure which shares one common intercommunicating passage 251, the ink can be fed more smoothly to working fluid chambers 227 and ink chambers 257.

As described above, according to the present invention, the ink is constantly fed into working fluid chambers 227 as the working fluid. Therefore, the excessive heating of working fluid chambers 227 and the back flow of the working fluid are prevented.

Although the preferred embodiment of the present invention has been shown and described, it will be appreciated by those skilled in the art that changes may be made in these embodiments without departing from the principles and spirit of the invention, the scope of which is defined in the following claims and their equivalents.

What is claimed is:

1. In a thermal-compression fluid-jetting printing apparatus comprising:

a nozzle module having an ink chamber for receiving ink, and a nozzle hole for permitting the ink in the ink chamber to be jetted out therethrough;

a driving module forming a working fluid chamber, the driving module having an electric heating element located in the working fluid chamber, the working fluid chamber having an ink-feeding hole through which the ink is fed from an external ink source; and a flexible membrane functioning as a partition between the ink chamber and the working fluid chamber, the membrane being adapted to expand flexibly in response to an increased pressure in the working fluid chamber during a heating operation of the heating element;

the improvement comprising: a passage communicating between the working fluid chamber and the ink chamber, said passage adapted for feeding to the ink chamber the ink fed into the working fluid chamber.

2. The apparatus of claim 1, wherein the ink feeding hole and the intercommunicating passage are located opposite one another in the working fluid chamber.

3. The apparatus of claim 2, wherein the working fluid chamber and the ink chamber are respectively comprised of a pair of working fluid chambers and a pair of ink chambers, which are formed in symmetrical relation with one another.

4. A method of maintaining ink jet pressure in a bubble jet printer apparatus and prolonging operating life of the printer apparatus, in a printer comprising:

a nozzle module having an ink chamber for receiving ink, and a nozzle hole for permitting the ink in the ink chamber to be jetted out therethrough;

a driving module forming a working fluid chamber, the driving module having an electric heating element located in the working fluid chamber, the working fluid chamber having an ink-feeding hole through which the ink is fed from an external ink source; and a flexible membrane functioning as a partition between the ink chamber and the working fluid chamber, the membrane being adapted to expand flexibly in response to an increased pressure in the working fluid chamber during a heating operation of the heating element;

said method comprising: providing a passage communicating between the working fluid chamber and the ink chamber, said passage adapted for feeding to the ink chamber the ink fed into the working fluid chamber.

5. The method of claim 4, wherein the ink feeding hole and the intercommunicating passage are located opposite one another in the working fluid chamber.

6. The method of claim 5, wherein the working fluid chamber and the ink chamber are respectively comprised of a pair of working fluid chambers and a pair of ink chambers, which are formed in symmetrical relation with one another.

* * * * *